US005098021A

United States Patent [19]

Kah, Jr.

[11] Patent Number: 5,098,021

[45] Date of Patent: Mar. 24, 1992

[54] OSCILLATABLE NOZZLE SPRINKLER WITH INTEGRATED ADJUSTABLE ARC AND FLOW

[76] Inventor: Carl L. C. Kah, Jr., 778 Lakeside Dr., N. Palm Beach, Fla. 33408

[21] Appl. No.: 516,362

[22] Filed: Apr. 30, 1990

[51] Int. Cl.[5] ..... B05B 3/16

[52] U.S. Cl. ..... 239/242; 239/231; 239/237; 239/507; 239/590

[58] Field of Search ..... 239/231, 236, 237, DIG. 1, 239/240, 242, 505, 507, 513, 514, 518, 569, 590, 590.5

[56] References Cited

U.S. PATENT DOCUMENTS

| | | | |
|---|---|---|---|
| 3,383,047 | 5/1968 | Hauser | 239/240 |
| 3,428,256 | 2/1969 | Painter | 239/236 |
| 3,528,093 | 9/1970 | Eerkens | 239/236 |
| 3,567,122 | 3/1971 | Congdon | 239/242 |
| 4,269,354 | 5/1981 | DeWitt | 239/DIG. 1 |
| 4,540,125 | 9/1985 | Gorney et al. | 239/236 |
| 4,566,633 | 1/1986 | Rinkewich | 239/237 |
| 4,648,558 | 3/1987 | Rabitsch | 239/DIG. 1 |
| 4,919,337 | 4/1990 | Van Leeuwen et al. | 239/242 |

*Primary Examiner*—Andres Kashnikow
*Assistant Examiner*—Christopher G. Tranor
*Attorney, Agent, or Firm*—Jack N. McCarthy

[57] ABSTRACT

An oscillatable nozzle sprinkler has a primary valve for controlling flow through a nozzle in a nozzle housing. An arc set control sets a desired angle of oscillation of the nozzle housing. An integrated system is set forth so that when a desired angle of oscillation is selected, the primary valve is positioned to provide a desired precipitation rate. A secondary valve is provided to achieve a uniform precipitation coverage.

30 Claims, 5 Drawing Sheets

Fig. 10
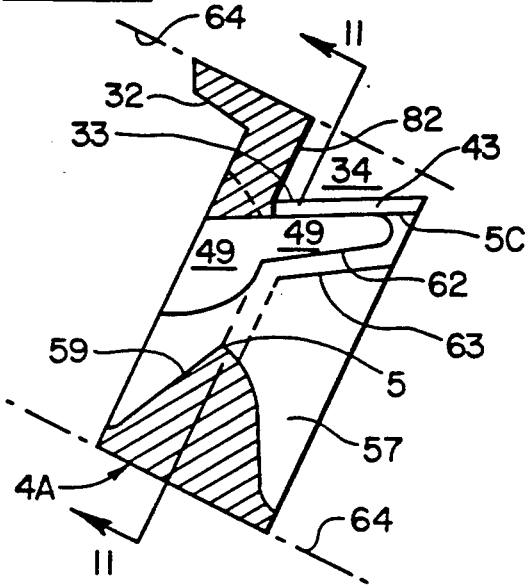
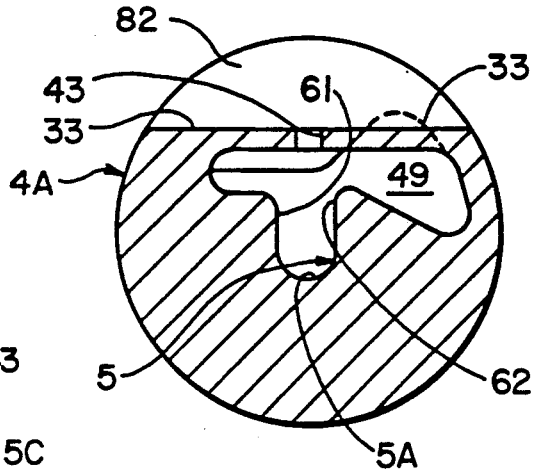
Fig. 11
Fig. 12
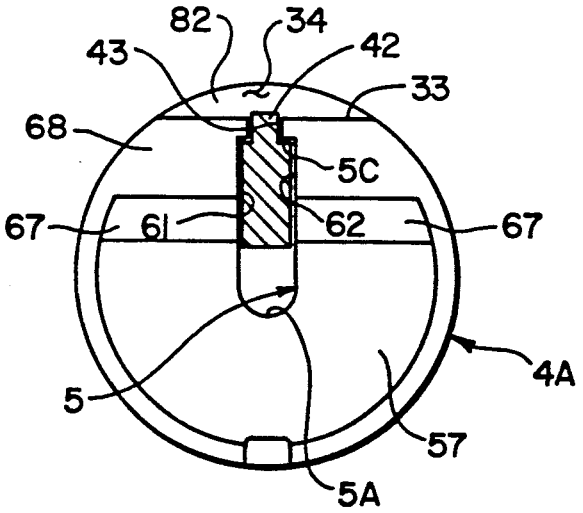
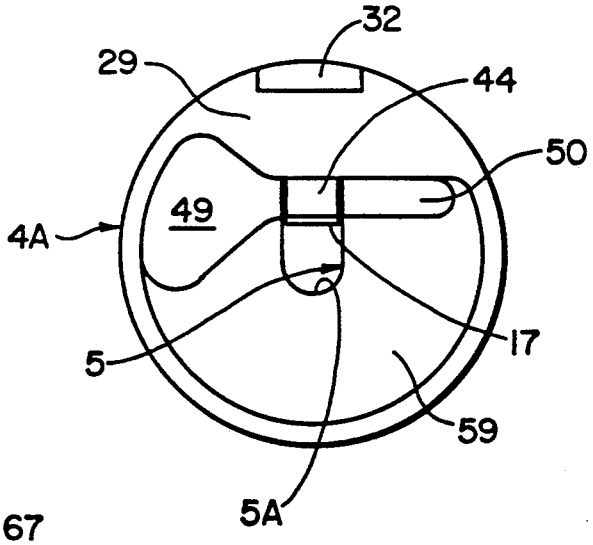
Fig. 13

OSCILLATABLE NOZZLE SPRINKLER WITH INTEGRATED ADJUSTABLE ARC AND FLOW

DESCRIPTION

1. Technical Field

This invention relates to oscillatable sprinklers being adjustable to select different arcs of coverage and having automatically adjustable nozzles to provide proper water precipitation over each arc of coverage selected.

2. Background Art

In U.S. Pat. No. 4,867,378, issued Sept. 19, 1989, a sprinkler is disclosed having an adjustable arc of oscillation and an indication of the arc which is set located on the top of the nozzle, and in my patent application Ser. No. 932,470, filed Nov. 18, 1986, a reversing gear drive with setable arc of oscillation is disclosed. These disclosures show prior art that is available for driving a rotating nozzle assembly and allowing the arc of rotation and oscillating nozzle movement to be driven and easily set and indicated.

Present oscillating nozzle sprinklers of this type are provided with a selection of nozzles of different flow rates (gallons per minute) to provide different precipitation rates and matched precipitation rates for various arcs (areas) of coverage over a given time period, i.e., 0.5 inches of precipitation per square foot per hour over the area of coverage. It can be seen that a sprinker with a fixed flow rate nozzle that is oscillating to cover 90 degrees would apply twice the water to its area of coverage as the same sprinkler would apply in the same time to an area when set to oscillate through 180 degrees of coverage.

With sprinklers that are presently on the market, the person installing the sprinkler must install, for example, a one-gallon-per-minute nozzle into the sprinkler that is going to operate over a 90-degree arc of coverage and a two-gallon-per-minute flow rate nozzle into the sprinkler that is going to operate over a 180-degree arc of coverage. The alternative to having to install different nozzles for different applications is to stock different sprinklers with the different nozzles already installed. This requires distributors to keep a much larger inventory on hand and requires installers to carefully plan exactly what sprinklers are required and where.

Also affected are sprinklers which are set at non-standard arc increments, such as a 120-degree arc, in which case the area would be overwatered or underwatered, depending upon which nozzle was chosen.

It is also necessary to achieve a particular fallout pattern of the water along the sprinkler's axis of propagation to achieve a uniform precipitation rate to the area of coverage as the sprinkler nozzle is rotated. The desired pattern may take on a particularized profile when different spacings of other sprinklers of the same type overlap each other.

The primary difficulty is getting a uniform droplet fallout precipitation with little fogging or direct hard spray onto the ground close into the sprinkler, i.e., range of 8 feet or less.

DISCLOSURE OF INVENTION

It is an object of this invention to provide an oscillating nozzle sprinkler which provides uniform precipitation over its area of coverage during a given time regardless of what arc of coverage is set.

It is a further object of this invention to provide a throttling nozzle configuration which is relatively insensitive to dirt particles over a wide throttling range.

Another object of this invention is to provide an attractive configuration for a throttlable secondary close-in coverage spray nozzle.

The purpose of this invention provides for automatic flow rate adjustment of the nozzle as the coverage arc of the sprinkler is set. The flow rate area of the nozzle is adjusted at the nozzle exit with full pressure across it so that the range of coverage is only slightly affected by the change of flow rate.

In this invention, the precipitation rate is established by the size of the opening between a throttling member and a nozzle throat which allows a particular flow through the nozzle for a particular arc of coverage.

It is an object of this invention to connect a device for changing the angular setting of a nozzle having an adjustable arc of oscillation with a device for simultaneously changing the flow through the nozzle. A nozzle flow control throttling member is moved relative to a nozzle by the rotation of an arc set stem.

It is a further object of this invention to cam the movement of a nozzle flow control throttling member to change the flow by the movement of a device for changing the angular setting of a nozzle.

Only one nozzle size is required for a particular precipitation rate for an oscillating sprinkler. Regardless of what arc of coverage it is set for, it will provide this precipitation rate by automatically increasing its flow rate as the arc of coverage is increased. All sprinklers in a yard could thus provide 0.5 inches of precipitation per square foot per hour, for example, regardless of what arc each was set to cover and without any special effort by the installer.

The stream angle into the air from the nozzle is established by the angle on the throttling member and can be easily changed to provide low angle for sprinklers for windy conditions and higher angle for low wind conditions to provide some increase in range.

An important feature of this disclosure is the simple way in which the throttling action takes place at the nozzle throat area to provide the full pressure available across the nozzle for maximum range rather than to throttle the flow upstream of the nozzle throat which would result in a flow reduction but also in a substantial reduction and variation in the range of the sprinkler's coverage.

Also in the configuration shown, an additional advantageous feature is throttling from one side of the nozzle throat area rather than a tapered plug into the center of the nozzle which divides the nozzle throat flow with the resulting non-axial stream component so that when the stream components come back together again in the center, it results in added turbulence reducing the range of the main stream coverage. Plug throttling is more desirable for secondary nozzles designed to provide closer spray coverage.

Also putting a plug into the center of the nozzle throat generates a smaller width cylindrical slot at the throttled position which, because of its thin width, is more sensitive to dirt particles than the single concentrated hole produced by the throttling member being introduced into the nozzle throat from the one side.

The same approach as used for the main nozzle stream can be used to throttle the flow in secondary nozzles that provide for closer-in fallout of the sprinkler's precipitation.

Another important understanding for this secondary nozzle is that the throttling member does not have to provide a leak-tight fit on its sides as it is desirable and necessary for the sprinkler nozzle to provide a significant amount of near-field precipitation to fall out closer to the sprinkler than what normally falls out of the main stream due to turbulence and wind shear on the main stream's outer surface.

The loose side fits of the throttling member in the nozzle can be sized and grooved to provide some of the close-in precipitation. Although the slot may have the full stream pressure drop available, because of its thin geometry, the air shear action on it causes it to break up earlier than the main stream which has much less surface area for its flow.

A throttlable secondary nozzle configuration is disclosed where throttlable secondary flow is directed against a splash surface and sprayed into secondary nozzle spray distribution cavities shaped to give the desired fallout pattern. An additional secondary nozzle spray breakup is provided by flow that is allowed to leak as a sheet to engage the flow sprayed into the secondary nozzle spray distribution cavities. This thin width flow, formed as a sheet, strikes the already broken up spray from the splash surface to provide closer-in precipitation.

Also the throttling member can be configured to have smaller (than the main nozzle) secondary nozzles formed between it and the fixed portion of the nozzle. Secondary nozzles are configured to provide the required close-in precipitation and are throttlable along with the throttling action on the main stream.

In another application of the variable flow features of the nozzle disclosed herein, the flow rate of a sprinkler can be changed for a fixed arc of oscillation to provide the desired precipitation for a specific arc of coverage requirement. A setable dial on the top of the nozzle housing can be used to only vary the flow area of the nozzle, for example, from 0.3 inches of precipitation per hour to 1.6 inches of precipitation per hour over the fixed (preset) area of oscillation of the sprinkler. The top of the nozzle housing of a fixed arc of oscillation sprinkler could show the flow calibration setting, i.e., 0.3 to 1.2 inches per hour, on the dial to position the nozzle flow control throttling member. This also has great potential as there are many applications for preset sprinklers with 90°, 180°, and 360° of oscillation but with different precipitation rates desired because of soil or shade conditions.

It should also be noted that the flow throttling nozzle could be used with a fixed arc of oscillation sprinkler to allow that sprinkler's precipitation rate to be changed without the inconvenience of changing nozzles.

BRIEF DESCRIPTION OF DRAWINGS

FIG. 10 is an enlarged view of the modified fixed nozzle shown in FIG. 8 with the nozzle flow control throttling member removed;

FIG. 11 is a sectional view of the fixed nozzle taken along line 11-11 of FIG. 10;

FIG. 12 is a rear end view of the fixed nozzle taken along arrow F of FIG. 8 with the nozzle flow control throttling member partially cut away;

FIG. 13 is a front end view of the fixed nozzle taken along arrow G of FIG. 8 with the nozzle control throttling member shown;

BEST MODE FOR CARRYING OUT INVENTION

Figure 1:
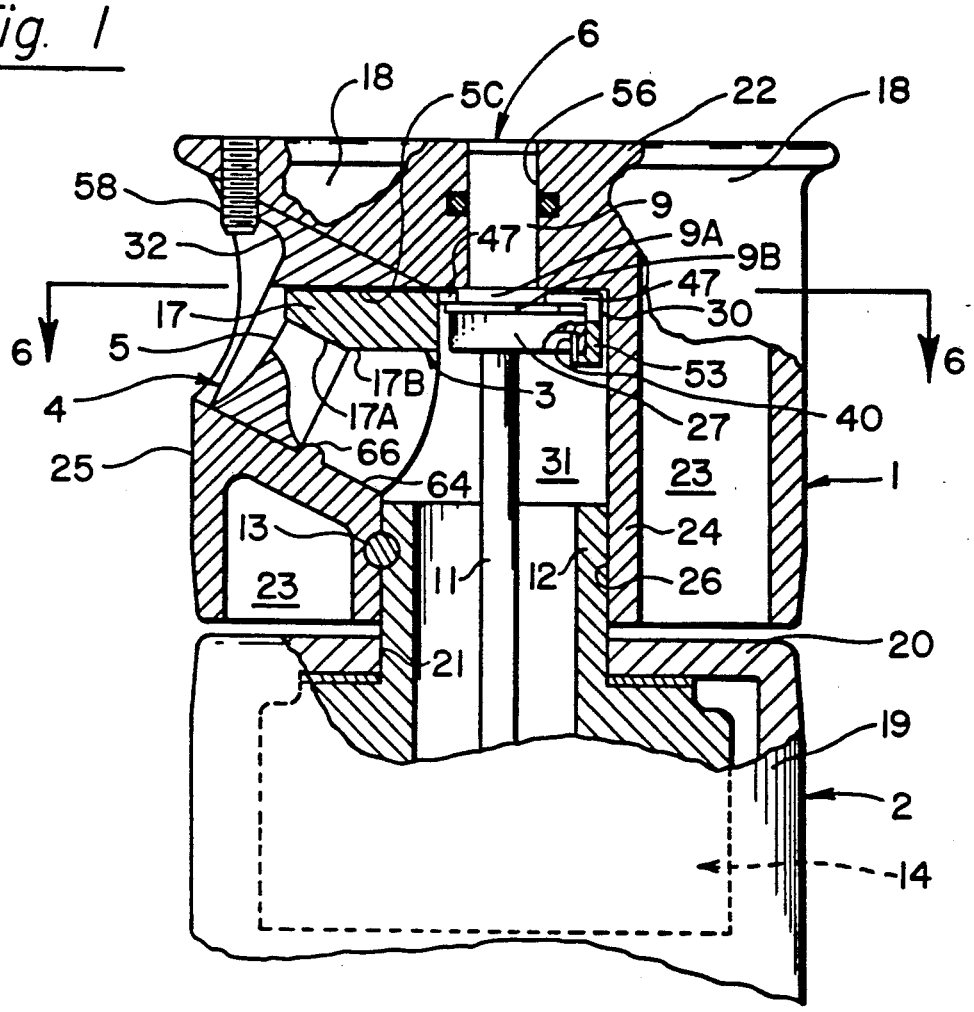
FIG. 1 is a fragmentary sectional side view of a rotatable sprinkler nozzle assembly, with a fixed nozzle, mounted on a partially sectioned riser assembly to show the rotatable sprinkler nozzle assembly drive output shaft and arrangement of the significant components of the arc set device and connected nozzle flow control throttling member in the rotatable sprinkler nozzle assembly; the nozzle flow control throttling member is shown in the withdrawn, full flow, position with respect to the fixed nozzle.
Figure 6:
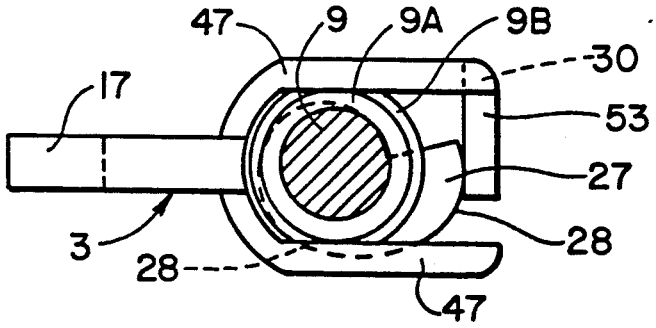
FIG. 6 is a view taken along line 6-6 of FIG. 1 showing the rectangular plug of nozzle flow control throttling member in its full flow relationship to the cam member of the arc set device (the fixed nozzle and nozzle housing are not shown in this Figure)
Figure 7:
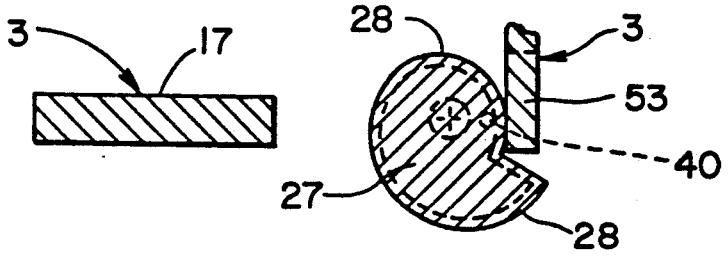
FIG. 7 is a layout view showing the rectangular plug of nozzle flow control throttling member in its minimum flow relationship to the cam member of the arc set device (the fixed nozzle and nozzle housing have also been removed and not shown in this Figure, as was also done in FIG. 6)
Figure 2:
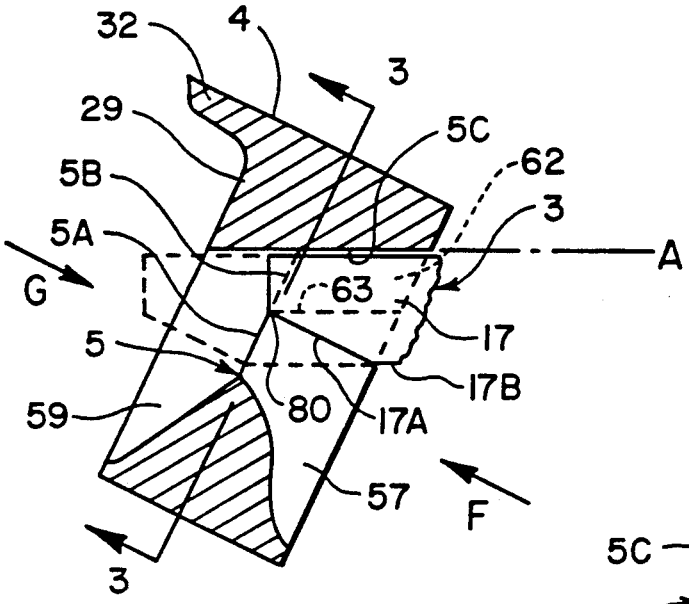
FIG. 2 is an enlarged view of the fixed nozzle shown in FIG. 1 with the nozzle flow control throttling member shown in phantom in its fully inserted, minimum flow, position.
Figure 3:
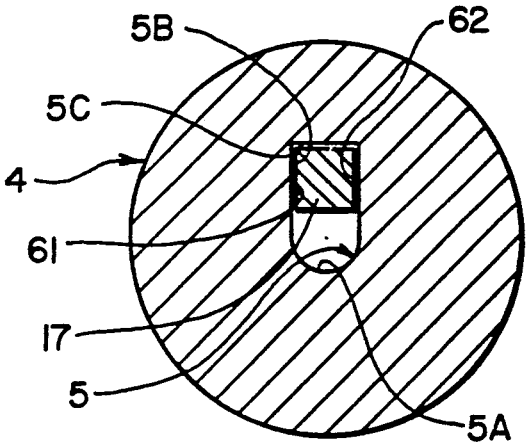
FIG. 3 is a sectional view of the fixed nozzle taken along the line 3—3 of FIG. 2.
Figure 4:
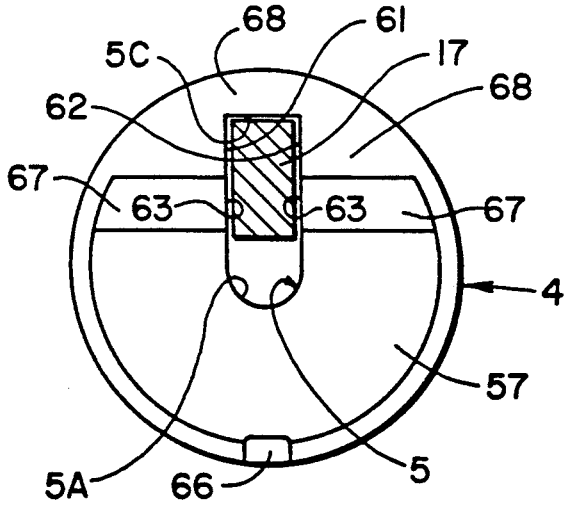
FIG. 4 is a rear end view of the fixed nozzle taken along arrow F of FIG. 2.
Figure 5:
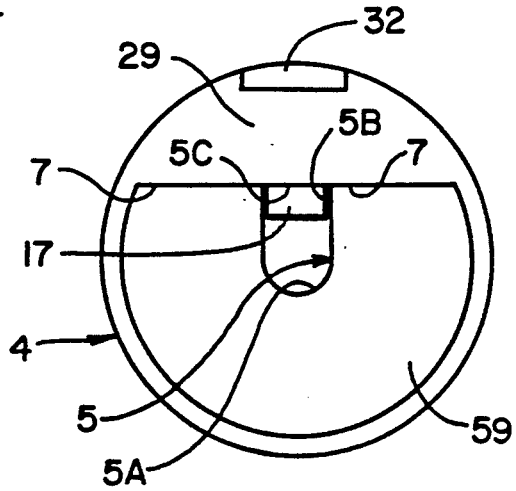
FIG. 5 is a front end view of the fixed nozzle taken along arrow G of FIG. 2.

Referring to FIG. 1 of the drawings, a rotatable sprinkler nozzle assembly 1 is shown on top of a cylindrical riser assembly 2, said riser assembly including a drive assembly 14; said drive assembly having (i) means for oscillating said sprinkler nozzle assembly 1; and (2) arc set means for setting the arc or angle of oscillation of said sprinkler nozzle assembly 1, said arc set means being actuated by arc set shaft 11.

Details of a drive assembly 14 are set forth in U.S. patent application Ser. No. 932,470, filed Nov. 18, 1986 and in U.S. Pat. No. 4,901,924, issued Feb. 20, 1990. Further background material is shown in U.S. Pat. No. 4,867,378, issued Sept. 19, 1989. These patents and patent applications are all in the name of Carl L. C. Kah, Jr. The contents of U.S. Pat. No. 4,867,378, U.S. Pat. No. 4,901,924, and U.S. Pat. application Ser. No. 932,470, just referred to, are incorporated herein by reference as though they were fully set forth.

The cylindrical riser assembly 2 has a housing 19 with a top cover 20 having an opening 21 at the center thereof for receiving a hollow rotatable output nozzle drive shaft 12 extending from drive assembly 14. Water from a supply (not shown) is directed to hollow shaft 22 into the rotatable sprinkler nozzle assembly 1.

The rotatable sprinkler nozzle assembly 1 is comprised of four main parts: a cylindrical nozzle housing 18, a fixed nozzle 4, a nozzle flow throttling member 3, and an adjustable arc set device 6 including rotatable arc set shaft 11 for (1) setting the arc of oscillation of the drive assembly 14; and (2) setting the nozzle flow throttling member 3 to control nozzle flow.

The cylindrical nozzle housing 18 has an outer surface 25 approximately the same diameter as that of riser assembly 2. The interior of the nozzle housing 18 is formed having a solid upper area 22 with a lower annular open area 23 formed around a cylindrical downwardly extending projection 24. The lower part of the cylindrical downwardly extending projection 24 extends just below the bottom edge of the cylindrical outer surface 25 of the nozzle housing 18, and has a cylindrical opening 26 to receive the hollow rotatable output nozzle drive shaft 12 of the drive assembly 14 of the riser assembly 2. The rotatable sprinkler nozzle assembly 1 is fixed to the hollow rotatable output nozzle drive shaft 12 by retaining pin 13.

A cylindrical opening 64 extends from the top portion of a central cavity flow area 31, formed by the cylindrical opening 26 in cylindrical projection 24, to the outside surface 65 of the cylindrical nozzle housing 18 at an upwardly sloped angle of, for example, 25 to 27 degrees for holding the fixed nozzle 4. A stop member 66 is located on the side of the cylindrical opening 64 to aid in providing for properly positioning the fixed nozzle 4 in the cylindrical nozzle housing 18. A removable stop 58 (1) prevents the water pressure in central cavity area 31 from blowing the fixed nozzle 4 out of the opening 64, and (2) provides for removing the fixed nozzle 4, if desired. The removable stop 58 shown is a nozzle retention screw located in a threaded opening in the top of the cylindrical nozzle housing 18.

There is a hole 56 through the solid upper area 22 of the nozzle housing 18 above the flat top of central cavity area 31 for rotatively mounting an enlarged top portion 9 of arc set device 6 and providing access to the top of the arc set device 6 for adjusting it. A slot 100 is provided to receive the end of a screwdriver, or special tool, to turn the arc set device 6. An arrowhead 102 points to a numbered angular position.

A first enlarged cylindrical portion 9A is located under top portion 9 to form a shoulder to engage the flat underside of solid upper area 22 to keep the arc set device 6 in place. A second enlarged cylindrical portion 9B is located under portion 9A to provide a shoulder spaced from the flat underside of solid upper area 22 to provide a spacing for supporting and allowing axial movement of nozzle flow throttling member 3, to be hereinafter described.

A fixed nozzle 4 shown in FIGS. 1-5 is formed having a primary flow opening nozzle throat 5 at a midpoint with its lower end formed as a semi-circle 5A with a rectangular opening 5B extending upwardly therefrom to receive a rectangular plug 17 of nozzle flow throttling member 3. Said rectangular opening 5B extends upwardly to a straight surface 5C; said surface 5C extends through said fixed nozzle 4 along line A (see FIG. 2) from the front end to the rear end thereof at an angle equal to the sloped angle of cylindrical opening 64, so that as the fixed nozzle 4 is placed in cylindrical opening 64 against stop 66, the surface 5C is perpendicular to arc set shaft 11 and spaced from the end of cylindrical opening 64. Line A extends from the rear end of the fixed nozzle 4 in line with the flat top of central cavity 31 and top of the first enlarged cylindrical portion 9A of arc set device 6.

Forwardly of the nozzle throat 5 location, the fixed nozzle 4 has a flat surface 7 extending from each side of surface 5C to the side of the fixed nozzle 4 forming a solid surface 29 at the front top of the nozzle 4. This surface 29 extends forwardly at an angle to engage the stop 58. The remainder of the front end of the fixed nozzle 4 around primary flow opening nozzle throat 5 below straight surface 5C is formed with a divergent downstream surface area 59.

Rearwardly of the nozzle throat 5 location, the fixed nozzle 4 has side surfaces 61 and 62 extending downwardly from each edge of straight surface 5C in line with rectangular opening 5B. The side surfaces 61 and 62 extend to bottom edges 63 which extend parallel to surface 5C, and pass through a point 80 adjacent the forward throttling edge of a lower throttling surface 17A of rectangular plug 17 in its rearwardmost withdrawn, full flow, position. Rectangular plug 17 has a straight top surface slidably positioned with relationship to straight surface 5C, with two sides slidably positioned with relationship to side surfaces 61 and 62. Throttling surface 17A extends rearwardly parallel to the center line of fixed nozzle 4 from point 80 to a straight bottom surface 17B which extends rearwardly parallel to the straight surface 5C. The rear surface of rectangular plug 17 extends into central cavity 31 spaced from arc set device 6 in its withdrawn, full flow, position. Rectangular plug 17 is actuated by the arc set device 6 in a manner to be hereinafter described. The throttling surface 17A is of such a length to provide the desired inserted, minimum flow, position when the rectangular plug 17 is moved to its forwardmost position.

Each bottom edge 63 extends to the side of the fixed nozzle 4 as a solid tapered surface 67 below the solid surface 68 around the rear ends of straight surface 5C, and side surfaces 61 and 62. The remainder of the rear end of the fixed nozzle 4 around primary flow opening nozzle throat 5 is formed with a convergent upstream surface area 57.

Nozzle flow throttling member 3 includes rectangular plug 17 having spaced apart arms 47 attached to the inner end of rectangular plug 17 and extending into central cavity 31 and into the spacing between the shoulder on enlarged cylindrical portion 9B and the flat underside of solid upper area 22 around cylindrical portion 9A. A cam member 27 having a two-sided downwardly extending peripheral spiral cam 28 is formed just below cylindrical portion 9B radially inward from the lower part of the rear surface of rectangular plug 17. A downwardly extending arm 30 fixes a cam follower arm 53 to the end of one arm 47. The downwardly extending arm 30 is of a length to place the cam follower arm 53 radially in line with the outer side of spiral cam 28. The position of cam member 27 sets the movement of rectangular plug 17 into the primary flow opening nozzle throat 5.

It can be seen that cam follower arm 53 is positively connected to cam 28 of cam member 27, to actuate rectangular plug 17 in both directions "IN" and "OUT" of fixed nozzle 4. Cam follower arm 53 extends below the bottom surface of cam member 27 and has an arm member project under said cam 28 of cam member 27; said arm member having a pin projection 40 extending upwardly to contact the inner side of cam 28 so that rotation of cam member 27 positively moves the rectangular plug 17 in either direction. Cam member 27 and arc set shaft 11 can be sized to avoid interference.

Figure 8:
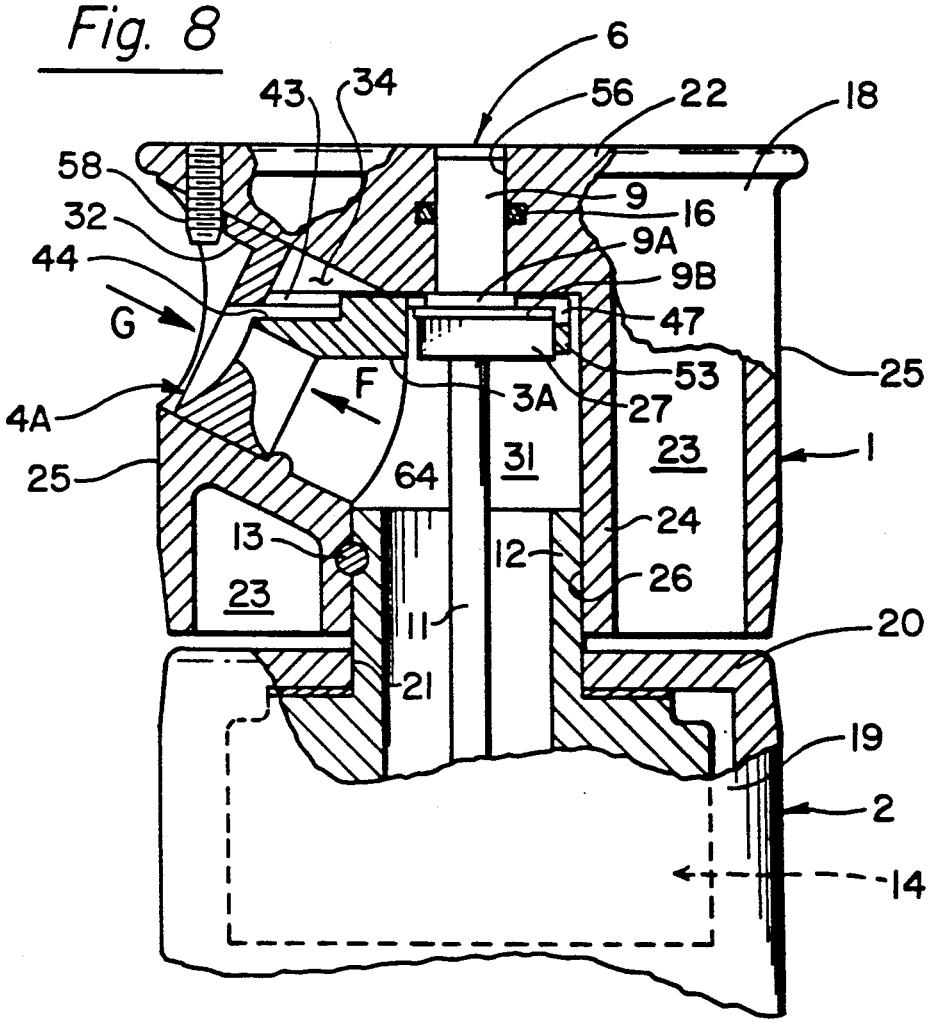
FIG. 8 is a view similar to FIG. 1 showing a modified fixed nozzle, and nozzle flow control throttling member providing for a throttlable secondary closein coverage spray nozzle.
Figure 9:
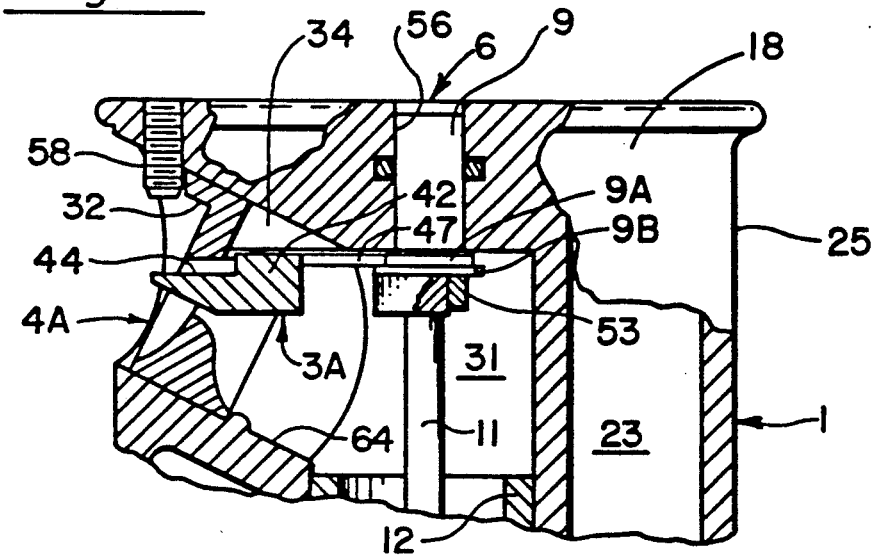
FIG. 9 is a view similar to FIG. 8 with the nozzle flow control throttling member shown in its fully inserted, minimum flow position with respect to the modified fixed nozzle. (A portion of the arc set cam has been cut away to show the minimum flow position of the cam follower for the minimum flow position of the nozzle flow control throttling member)

If desired, the arm member projecting under cam 28 of cam member 27 and pin projection 40 can be omitted to rely on water flow within central cavity flow area 31 entering from hollow shaft 12 and acting on the nozzle flow throttling member 3 to move rectangular plug 17 into the nozzle throat 5 as permitted by the outer side of spiral cam 28 of cam member 27 which is contacted by follower arm 53. Rectangular plug 17 is moved out of the nozzle throat 17 as cammed by the outer side of spiral cam 28 (as shown in FIGS. 8 and 9).

Figure 14:
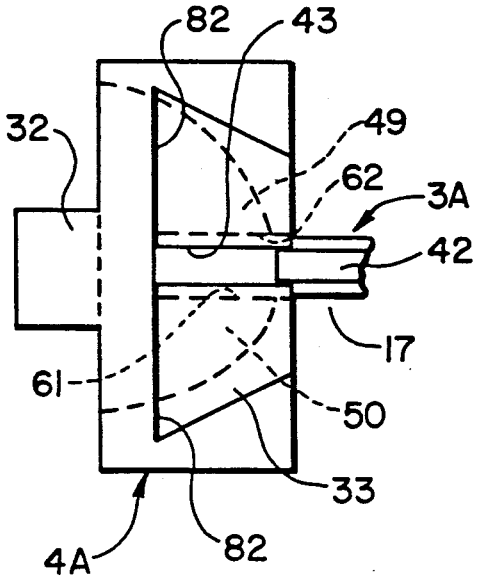
FIG. 14 is a top view of the modified fixed nozzle of FIG. 10 showing the secondary nozzle throttling slot along the top of the fixed nozzle with the secondary nozzle throttling rib of the nozzle flow control throttling member shown in its full flow position.
Figure 15:
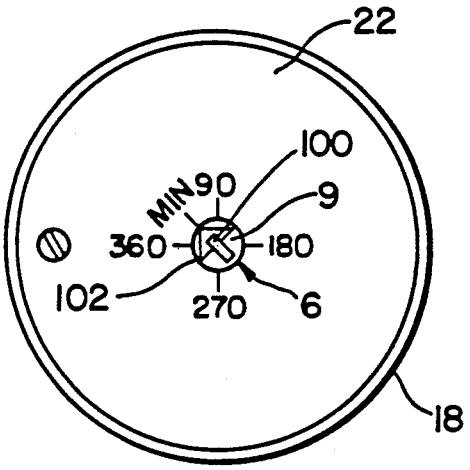
FIG. 15 is a top view of the nozzle assembly showing the arc set device set for the minimum arc of oscillation as would be the case for FIG. 9, and the positioning of the nozzle flow control throttling member shown in FIG. 7.

The modified fixed nozzle 4A with a modified nozzle flow control throttling member 3A provides for a secondary close-in coverage spray nozzle. As seen in FIGS. 8, through 14, a portion of the nozzle 4A is removed back of a surface 82 spaced from the front of the nozzle 4A, and above a flat surface 33 spaced a short distance from, and parallel to, the surface 5C. Surface 82 and surface 33 form an open area 34 opening rearwardly into cylindrical opening 64 to receive water flow from central cavity flow area 31.

An elongated slot 43 is placed in surface 5C through to surface 33, from the bottom of surface 82 to the rear end of the fixed nozzle 4A. An upper extending rib 42 is formed at the back end of the straight top surface of modified rectangular plug 17 of modified nozzle flow control throttling member 3A to project into the elongated slot 43. The front end of the top surface of the modified rectangular plug 17 ahead of upper extending rib 42 is cut down to incorporate a splash plate 44 below elongated slot 43.

The modified rectangular plug 17 is of a length s that at the rearwardmost withdrawn, full flow, position of modified rectangular plug 17 it covers the rear end of elongated slot 43 and rear area above splash plate, or surface, 44. It can be seen that as upper extending rib 42 moves between its rearwardmost withdrawn, full flow, position to its forwardmost inserted, minimum flow, position, the opening provided by elongated slot 43 is varied from its largest opening to its smallest opening, changing the length of the jet flow impinging on splash plate 44. This arrangement acts as a secondary spray nozzle to help provide the closer distribution to obtain the desired uniformity of precipitation over a wide range of angular settings.

The impinging flow splashes to each side of splash plate, or surface, 44 and enters a cavity formed on each side; a cavity 49 is shown on the left side of the fixed nozzle 4A, and a cavity 50 is shown on the right side. Cavity 49 extends from a point adjacent the rear of surface 62 and curves outwardly and forwardly to the front surface of the modified fixed nozzle 4A. Cavity 49 also curves upwardly and downwardly after it passes the nozzle throat 5. Cavity 50 extends from a point adjacent the rear of surface 61 and curves outwardly, a shorter distance than cavity 49, and forwardly to the front surface of the modified fixed nozzle 4A. The cavity 50 extends approximately the same height for its entire length.

It can be seen that different contoured cavities, such as 49, 50, and others not shown, can alter the effect of the secondary flow on the close distribution of the spray. Differently shaped cavities can be used to achieve different desired effects.

It can be seen that the sheet leakage allowed to flow between modified rectangular plug 17 and side surfaces, or walls, 61 and 62, impinges on the flow splashes to each side of splash plate, or surface, 44 to further break up the momentum of the secondary spray to provide closer-in, large droplet, precipitation. This action achieves close-in water droplet fallout while not producing hard direct spray on the ground and achieves close-in larger droplet fallout without having to rely on spray small droplet fogging to provide for the close-in precipitation. The sheet leakage allowed can be changed by controlling the width of the modified rectangular plug 17 or the distance between the side surfaces, or walls, 61 and 62. Small projections can be placed on a side surface, or wall, 61 or 62, to provide a specific desired spacing on that side with the modified rectangular plug 17.

When it is desired to use the fixed nozzle 4 and nozzle flow throttling member 3 with a sprinkler having a fixed arc of oscillation to merely vary the precipitation per hour for the fixed area covered, the arc set device 6 is mounted for rotation in its nozzle housing location by means other than arc set shaft 11. Arc set shaft 11 is only used when a variable arc of oscillation sprinkler is used.

Figure 17:
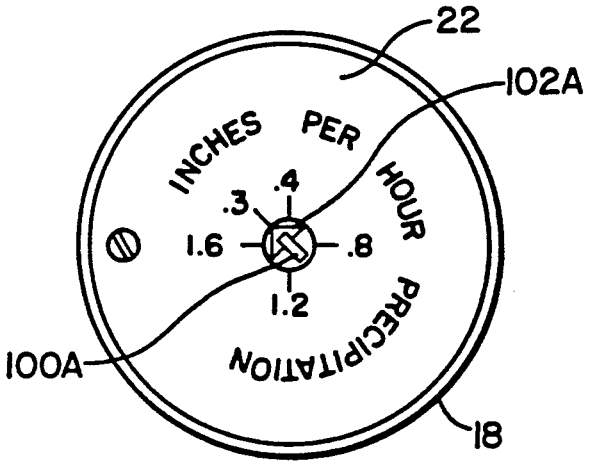
FIG. 17 is a top view of the nozzle assembly of a fixed arc of oscillation sprinkler showing the flow calibration setting around a dial for positioning a nozzle flow control throttling member.

The setable dial on the top of the nozzle housing 18 has, for example (see FIG. 17), settings of from 0.3 inches per hour to 1.6 inches per hour. A pointer, or arrowhead, 102A on the top of portion 9 of the arc set device 6, in line with a turning slot 100A, indicates the desired precipitation. This setting sets the nozzle flow throttling member 3 with the fixed nozzle 4 to obtain the desired precipitation for a fixed arc.

Figure 16:
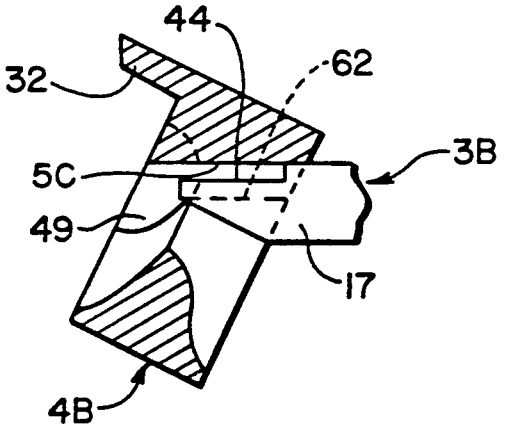
FIG. 16 is a sectional side view of a second modified fixed nozzle also providing a secondary closein coverage with a portion of the nozzle flow control throttling member shown in its full flow position.

FIG. 16 discloses a second modified fixed nozzle 4B and nozzle flow throttling member 3B. Modified fixed nozzle 4B has cavities 49 and 50 such as fixed nozzle 4A, but has an upper straight surface 5C, without an extended slot 43, such as in fixed nozzle 4. The nozzle flow throttling member 3B is the nozzle flow throttling member 3 with a splash surface, or plate, 44. The secondary flow is provided by the leaking flow permitted at the sides 61 and 62 (see FIG. 4). This leaking flow splashes up against surface 5C and then to the sides to the shaped cavities 49 and 50. Throttling occurs by the changing of the length available for leaking.

While the principles of the invention have now been made clear in an illustrative embodiment, it will become obvious to those skilled in the art that many modifications in arrangement are possible without departing from those principles. The appended claims are, therefore, intended to cover and embrace any such modifications, within the limits of the true spirit and scope of the invention:

I claim:

1. A rotary drive sprinkler having a riser housing, said riser housing having an output shaft means, a nozzle assembly means for receiving a supply of water, said nozzle assembly means having a nozzle for directing water therefrom, said output shaft means being connected to said nozzle assembly means, means for oscillating said output shaft means and said nozzle assembly means, arc set means for setting a desired angle of oscillation of said nozzle assembly means, and means for varying the water flow through said nozzle as said arc set means is set.

2. A combination as set forth in claim 1 wherein said arc set means has a rotatable member in said nozzle assembly means, said arc set means being connected to said means for varying the water flow through said nozzle to vary the water flow as the angle of oscillation is reset 3. A combination as set forth in claim 1, said nozzle having a nozzle throat formed having an arcuate bottom portion and a rectangular top portion, a flow throttling member positioned to move "into" and "out of" said rectangular top portion to throttle flow.

4. A combination as set forth in claim 1 wherein said arc set means includes a rotatable shaft in said nozzle assembly means, said rotatable shaft being connected to said means for varying the water flow.

5. A combination as set forth in claim 3, said rectangular top portion of said nozzle throat having a top and two sides, said flow throttling member being rectangular in cross-section to cooperate with the top and two sides of said rectangular top portion of said nozzle throat to slide therein.

6. A combination as set forth in claim 5, said bottom portion of said nozzle throat having a convergent surface providing an inlet thereto.

7. A combination as set forth in claim 5 wherein said nozzle assembly means has a nozzle housing, said nozzle having an outer surface for sliding into an opening in said nozzle housing, said nozzle having a front end and a rear end, said nozzle housing having an opening for receiving said nozzle at an upwardly sloped angle, said nozzle having a top straight surface extending therethrough from the front end to the rear end aligned with the top of said nozzle throat and extending the width thereof, said rectangular flow throttling member being aligned parallel to said straight surface with one surface adjacent thereto and extending from the rear end of said nozzle into a cavity in said nozzle housing, said arc set means including a rotatable member in said nozzle housing extending through said cavity, said arc set means having a cam means thereon in said cavity, said rectangular flow throttling member having a cooperating cam follower means, said cam follower means being connected to said cam means for changing the position of said rectangular flow throttling member with said nozzle throat as said arc set means resets the angle of oscillation of said nozzle.

8. A combination as set forth in claim 7 wherein said nozzle has side surfaces extending from said nozzle throat to the rear end of said nozzle and downwardly from the sides of said top straight surface, said top straight surface and side surfaces guiding said rectangular flow throttling member, the width of said rectangular flow throttling member provides a space between each side of said rectangular flow throttling member and said side surfaces, said space on each side of said rectangular flow throttling member providing passages for secondary flow formed as a sheet for intersecting flow through said throat opening.

9. A combination as set forth in claim 8 wherein said rectangular flow throttling member has a cutout forward section forming a flat surface spaced from the top surface extending through said nozzle, one of said side surfaces having an elongated opening extending along its length adjacent said cutout section, said elongated opening having a curved surface extending from a rearward point to the front end of the nozzle, said elongated opening receiving flow from said passages for secondary flow and directing it forwardly of the front end of the nozzle.

10. A combination as set forth in claim 9 wherein said nozzle has a cavity formed above said top surface for receiving flow to said nozzle, a slot formed in said top surface extending into said cavity for providing a secondary flow into said flat surface section on said rectangular flow throttling member.

11. A combination as set forth in claim 10 wherein said rectangular flow throttling member has a projecting rib along its rearward section back of said cutout forward section projecting into said slot to act as a secondary valve to control flow through said slot as said rectangular flow throttling member moves between its maximum flow "OUT" position and its minimum flow "IN" position in said throat opening.

12. A combination as set forth in claim 1, said nozzle having a nozzle throat, a flow throttling member positioned to move "into" and "out of" said nozzle throat to vary the nozzle throat area.

13. A combination as set forth in claim 1, said nozzle having a nozzle throat and secondary spray flow passage, a flow throttling member positioned to move "into" and "out of" said nozzle throat to vary the nozzle throat area and secondary spray flow passage area.

14. An oscillating sprinkler having a selectable angle of oscillation for distributing water over different size areas of coverage, means for adjusting said oscillating sprinkler to apply water over a desired size area of coverage, means for automatically applying a uniform precipitation rate over any selected size area of coverage.

15. A variable nozzle having a front end and a rear end, a flow passage therethrough from said front end to said rear end, said flow passage having a throat opening, said throat opening having a bottom portion and a top portion, a flow throttling member positioned to move between a maximum flow "out" position and a minimum flow "in" position within said throat opening to throttle flow, said top portion of said nozzle throat having a top and two sides, said flow throttling member being shaped in cross-section to cooperate with the top and two sides of said top portion of said nozzle throat to slide therein, the bottom of said flow throttling member coacting with said nozzle throat including said bottom portion to form a varying area.

16. A combination as set forth in claim 15 wherein said top and two sides of said top portion have surfaces extending through said nozzle, the width of said flow throttling member provides a space between each side of said flow throttling member and said side surfaces extending through said nozzle, said space on each side of said flow throttling member providing passages for secondary flow formed as a sheet for intersecting flow through said throat opening.

17. A combination as set forth in claim 15 wherein the portion of said nozzle throat below the flow throttling member when it is positioned in its maximum flow "out" position has a convergent surface providing an inlet thereto.

18. A combination as set forth in claim 15 wherein the lower portion of the front end of said nozzle has a divergent surface downstream of said nozzle throat providing an outlet therefrom.

19. A combination as set forth in claim 15 wherein said variable nozzle is positioned in a rotatable nozzle housing, means for oscillating said nozzle housing, arc set means for setting a desired angle of oscillation of said nozzle housing, means for setting said flow throttling member at a desired position for providing a desired flow for cooperating with said desired angle of oscillation setting set by said arc set means.

20. A combination as set forth in claim 19 wherein said arc set means has a rotatable member in said nozzle housing, said arc set means being connected to said means for setting said flow throttling member to set a desired flow corresponding to a desired angle of oscillation.

21. A combination as set forth in claim 16 wherein said flow throttling member has a cutout forward section forming a flat surface spaced from the top surface extending through said nozzle, one of said side surfaces having an elongated opening extending along its length adjacent said cutout section, said elongated opening having a curved surface extending from a rearward point to the front end of the nozzle, said elongated opening receiving flow from said passages for secondary flow and directing it forwardly of the front end of the nozzle.

22. A combination as set forth in claim 21 wherein said nozzle has a cavity formed above said top surface for receiving flow to said nozzle, a slot formed in said top surface extending into said cavity for providing a second secondary flow into said flat surface section on said flow throttling member.

23. A combination as set forth in claim 22 wherein said flow throttling member has a projecting rib along its rearward section back of said cutout forward section projecting into said slot to act as a secondary valve to control flow through said slot as said flow throttling member moves between its maximum flow "out" position and its minimum flow "in" position in said throat opening.

24. A combination as set forth in claim 15 wherein said throat opening has an arcuate bottom portion and a rectangular shaped top portion, and said flow throttling member is rectangular in cross-section.

25. A combination as set forth in claim 22 wherein said second secondary flow from said slot impinges on said flat surface and splashes into said elongated opening.

26. A combination as set forth in claim 25 wherein said first named secondary flow impinges on said splash formed by said second secondary flow.

27. A rotary drive sprinkler having a nozzle with a front end and a rear end, a flow passage therethrough from said rear end to said front end, said flow passage having a throat opening for a primary flow, said nozzle having means providing two secondary flows which impinge on each other to provide sprinkler coverage close in to the sprinkler, and wherein said means providing two secondary flows has a cavity intersecting the front end of said nozzle, one of the secondary flows impinging on the other of the secondary flows within said cavity.

28. A combination as set forth in claim 27 wherein said cavity is spaced from said throat opening for said primary flow.

29. A combination as set forth in claim 28 wherein said cavity has end and side shapes to produce the desired fallout distribution.

30. A nozzle housing having a top thereon, said nozzle housing having a nozzle for directing water therefrom, a rotatable member mounted in said housing, said rotatable member having a top surface extending to the top of said housing, means for varying the water flow through said nozzle as said rotatable member is rotated, said nozzle housing top and said top surface of said rotatable member having cooperating indicia to indicate the rate of precipitation being produced by the sprinkler.

* * * * *